United States Patent [19]

Salmon

[11] Patent Number: 4,515,245

[45] Date of Patent: May 7, 1985

[54] OIL FILLER EXTENSION

[75] Inventor: Dennis E. Salmon, Cedar Springs, Mich.

[73] Assignee: Rockford Enterprises, Inc., Rockford, Mich.

[21] Appl. No.: 522,962

[22] Filed: Aug. 15, 1983

[51] Int. Cl.[3] ..... B67C 11/00; F01M 11/04

[52] U.S. Cl. ..... 184/105 R; 141/331; 141/391; 141/392; 220/4 A; 220/85 F; 220/86 R; 220/295; 220/301; 285/360

[58] Field of Search ..... 184/105 R, 105 B, 105 C; 141/391, 392, 367, 368, 327, 326, 98; 220/86 R, 85 SP, 85 F, 4 A, 295, 301; 285/360, 361, 376, 396, 401, 402

[56] References Cited

U.S. PATENT DOCUMENTS

| | | | |
|---|---|---|---|
| 25,117 | 8/1859 | Henease | 285/360 |
| 179,947 | 7/1876 | O'Neill | 285/361 X |
| 198,932 | 1/1878 | Edwards et al. | 285/360 |
| 1,351,338 | 8/1920 | Magee | 285/382.5 X |
| 1,461,436 | 7/1923 | Arrigoni | 220/86 R |
| 1,463,202 | 7/1923 | Douglas | 220/86 R |
| 1,549,858 | 8/1925 | Evans | 285/361 X |
| 1,960,928 | 5/1934 | Stant | 220/295 |
| 2,130,085 | 9/1938 | Harks | 184/105 R |
| 2,578,184 | 12/1951 | Green | 220/86 R |
| 3,990,489 | 11/1976 | Ruter | 184/105 R X |
| 4,112,984 | 9/1978 | Guglia et al. | 220/4 A X |
| 4,338,983 | 7/1982 | Hatcher | 141/331 |
| 4,379,574 | 4/1983 | Leichtl | 220/85 SP X |
| 4,416,391 | 11/1983 | Sarrazin | 220/295 X |

*Primary Examiner*—Allan N. Shoap

*Attorney, Agent, or Firm*—Price, Heneveld, Huizenga & Cooper

[57] ABSTRACT

A sheet metal oil filler extension formed of a metal tube having a stamped metal fitting on one end with a seal and a spring washer therearound for sealed attachment to an engine valve cover, and an annular sheet metal cap on the other tube end to receive a removable cover.

1 Claim, 7 Drawing Figures

OIL FILLER EXTENSION

BACKGROUND OF THE INVENTION

This invention relates to an oil filler extension tube, and more particularly to a formed metal oil filler extension for attachment to the valve cover of an internal combustion engine.

Many current automobile engines provide an oil filler opening in the top surface of the valve lifter cover i.e. rocker arm cover. A removable cap allows oil to be added to the engine via this opening. However, a commonly experienced problem with such arrangements is the oil spillage that occurs when doing so. The inconvenient location of this opening flush with the valve cover inhibits easy addition of oil.

SUMMARY OF THE INVENTION

An object of the present invention is to provide a novel metal oil filler tube extension. The extension attaches readily to the conventional valve cover allowing easy addition of oil without spillage. The unit accommodates valve covers of different model automobile engines. It is formed of stamped metal fittings secured to the ends of a sheet metal tube, with a spring biased seal thereon. The metal unit adapts readily to engine temperature changes, achieving proper connection to the valve cover so that the unit can be effectively sealed and left permanently on the engine. Further, the unit can be readily and properly connected to valve covers having different thickness metal, and to the fastening ears of different covers even though the ears may vary from cover to cover.

These and other objects, advantages and features of the invention will be apparent upon studying the specification in conjunction with the drawings.

DESCRIPTION OF THE PREFERRED EMBODIMENT

Referring now specifically to the drawings, the sheet metal oil filler extension assembly 10 there depicted includes an elongated sheet metal cylindrical tube 12, a connector fitting subassembly 14 on one end of the tube, for attachment to the conventional filler opening of an engine valve lifter cover (not shown), and an annular cap subassembly 16 on the opposite end of the tube.

Figure 6:
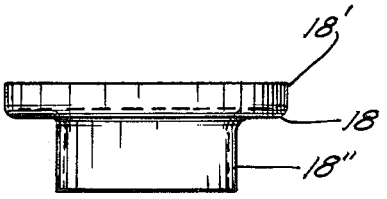
FIG. 6 is an elevational view of the nipple forming part of the right end of the unit in FIG. 1.
Figure 7:
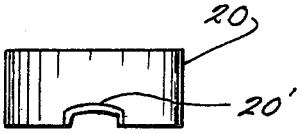
FIG. 7 is the connector to be attached to the nipple of FIG. 6.

Fitting subassembly 14 is composed of an annular nipple adaptor 18 (FIG. 6) having a larger diameter portion 18' which has an internal diameter the same as the external diameter of tube 12 to fit thereover and be welded thereto. Nipple 18 also has a smaller diameter portion 18'' with an outer diameter equal to the inner diameter of sleeve 20 (FIG. 7) so that the sleeve can be fitted over and welded to this smaller diameter portion.

The external diameter of the sleeve is sufficiently small so as to fit into the conventional opening in a valve cover. Sleeve 20 has at its outer end a pair of oppositely laterally extending bosses 20' which serve as cam followers to engage with the tapered undersurface of a conventional double cam track lip on the conventional valve cover opening. Nipple 18 and sleeve 20 are stamped from sheet metal.

Locked behind the inner axial end of sleeve 20, against the axial face of enlarged diametral portion of nipple 18, is the inner diameter portion of an annular canted spring washer 24. Spring washer 24 has its outer diametral portion canted axially toward the adjacent free end of the assembly 10, i.e. toward bosses 20', applying a biasing force against the adjacent annular resilient washer 26 of rubber. Thus, when this subassembly is interconnected with the conventional valve cover opening, with ears 20' hooked beneath the cam tracks of such opening, resilient seal 26 is pressed against spring washer 24 to deflect the latter against its inherent bias and achieve a tight seal to the valve cover.

Figure 1:
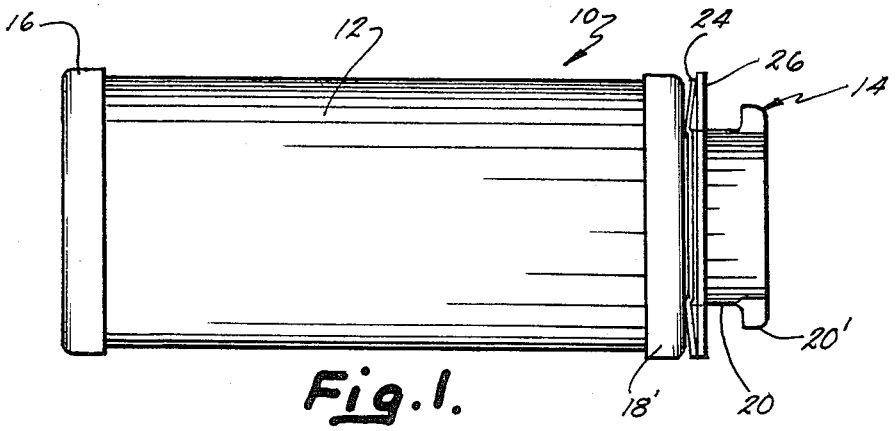
FIG. 1 is a side elevational view of the novel unit.
Figure 2:
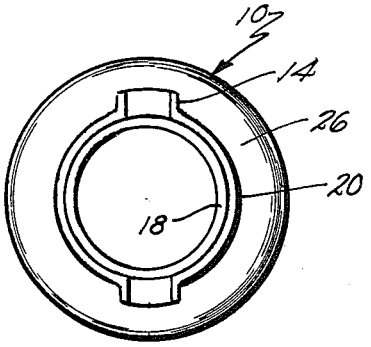
FIG. 2 is an end elevational view of the right end of FIG. 1.
Figure 3:
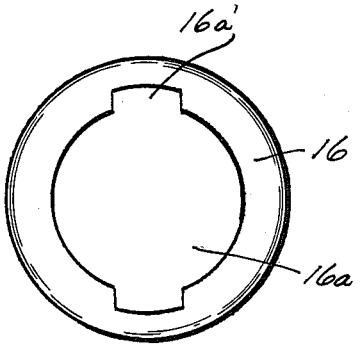
FIG. 3 is an end view of the left end of the unit in FIG. 1.
Figure 4:
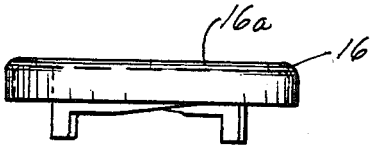
FIG. 4 is an elevational view of the annular cap at the left end of FIG. 1.
Figure 5:
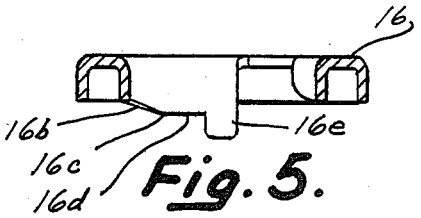
FIG. 5 is a sectional view of the cap.

At the opposite end of tube 12 is an annular cap which has an inner diameter equal to the external diameter of tube 12, to be fitted thereover for weldment thereto. This annular cap is a stamped sheet metal member with a U-shaped cross sectional configuration at its periphery. The central opening **16*a* has a pair of cutouts 16*a'* to receive the conventional locking lugs of the closure cover normally fitted into the opening of the conventional valve cover. There are two locking ramps extending from these cut-out areas, each locking ramp including an inclined surface 16*b* (FIG. 5), an apex 16*c*, and a slightly declining ramp surface 16*d* as well as an abutment stop 16*e*. Thus, the conventional cover can be lockingly interengaged with this by having the lugs on the conventional cover more past the apex and into abutment with the stop 16*e***.

The resulting device is relatively inexpensively manufactured, easy to use, permanently or removably installable on the engine, capable of accommodating temperature gradations, securely and sealingly engageable to the engine valve cover.

The embodiments of the invention in which an exclusive property or privilege is claimed are defined as follows:

1. A sheet metal oil filler extension for providing an extended passageway to an opening of a conventional engine valve lifter cover having a cap connector, said cap connector including said opening at its periphery having a plurality of cut outs for receiving the bosses on the neck portion of a conventional cap and a depending flange providing camming ramps with tapered undersurfaces over which the bosses of said cap cam and follow to retain the cap on said valve lifter cover comprising:

an elongated substantially rigid sheet metal tube;

an annular sheet metal fitting secured to one end of said tube, said fitting including a cylindrical collar fitted on and secured to one end of the tube; a flange extending radially inwardly from said collar and defining a central opening communicating with the opening through said tube; a neck extending from said flange and having a smaller diameter than the diameter of said tube, said neck corresponding in shape to the neck portion of said conventional cap thereby having a plurality of bosses extending radially therefrom for attachment of said fitting and tube to a conventional oil filler opening of an engine valve lifter cover;

seal means for sealing said fitting within the valve lifter cover;

a second annular sheet metal fitting comprising a cap connector secured on the other end of said tube, said cap connector having a U-shaped cross-sectional configuration at its periphery thereby providing two concentric inner and outer flanges connected together by a bight portion and defining a central opening communicating with the opening through said tube; said outer flange being secured to said other end of said tube and said inner flange having tapered under surfaces providing camming ramps;

said bight portion and said inner flanges having a plurality of cut outs for receiving the bosses on the neck portion of a conventional cap and said camming ramps providing tapered undersurfaces over which the bosses of said cap cam and follow to retain a conventional removable cap on said metal tube.

* * * * *